US005159772A

United States Patent [19]

Akaley

[11] Patent Number: 5,159,772

[45] Date of Patent: Nov. 3, 1992

[54] LIGHTED DISPLAY SIGNS

[76] Inventor: George E. Akaley, 225 North Burnett Rd., Cocoa, Fla. 32926

[21] Appl. No.: 617,643

[22] Filed: Nov. 26, 1990

[51] Int. Cl.[5] ..... G09F 13/26

[52] U.S. Cl. ..... 40/545; 40/605

[58] Field of Search ..... 40/545, 576, 605; 445/22, 26, 16, 38

[56] References Cited

U.S. PATENT DOCUMENTS 2,106,331 1/1938 Smith ..... 40/545
2,140,703 12/1938 Kenigsberg ..... 40/545
4,532,579 7/1985 Merryman ..... 40/576 X
5,036,243 7/1991 Cocks et al. ..... 40/545 X

*Primary Examiner*—Kenneth J. Dorner
*Assistant Examiner*—J. Bonifanti
*Attorney, Agent, or Firm*—John B. Dickman, III

[57] ABSTRACT

A lighted display sign with a moulded base having a channel forming a character, an electrical means for exciting a neon gas in the channel to emit light, electrical contacts extending from the base to connect to a power source and a second pair of electrical contacts extending from the base to connect to a second display sign.

7 Claims, 1 Drawing Sheet

LIGHTED DISPLAY SIGNS

BACKGROUND OF THE INVENTION

The field of the invention relates to lighted display signs, and, in particular, lighted display signs of the discharge type with interchangeable parts in order to create different messages.

The most common lighted display signs are neon signs which use a controlled, glowing discharge through inert gases. Most display signs utilize translucent tubing having a tortuous path forming a message or design. Other lighted displays are produced without translucent tubing, using multiple flat sheets assembled with a tortuous path interior of the sheets hermetically sealed with a rare gas, such as neon. U.S. Pat. Nos. 4,584,501, 4,839,555 and 4,887,003 describe the use of multiple sheets with a tortuous path filled with rare gases connected to a discharge to excite the gases, producing a display sign. Generally, the front sheet is transparent to emit light and the rear sheet is mirrored to reflect light toward the front sheet.

The prior art lighted display signs all present the same type of display sign where an entire message is displayed as a unit. The problem with such an arrangement is, should one of the electrodes break down or should the tortuous path leak, the entire sign has to be repaired. Some signs, like old transparent tubing signs, may require a lot of down time for repairs, particularly if a section of tubing has to be replaced. The solution is to provide a lighted display sign where an entire defective area can be removed and replaced in a short time. The present invention provides such a solution. Also, the prior art devices cannot be mass produced.

SUMMARY OF THE INVENTION

The invention provides a lighted display of the gas discharge type which uses a plurality of electrically connected displays to create a complete sign. Individual displays are fabricated of die stamped metal or glass or moulded plastic with the shape of a letter or character. The letter or character is stamped into the metal, glass or moulded in the plastic as a channel. The metal or plastic is covered by a transparent sheet which seals the channel. The channel is evacuated to purge air from it, and a rare gas such as neon is drawn in to fill the channel. A pair of electrodes are connected to the channel to excite the rare gas. In order to light the entire letter or character the channel may be divided into two halves in such a way that a complete circuit is made around the character without any short cuts for the electrical current. Where a die stamped metal or glass is used it must be coated with a non-conductive material that will not contaminate the neon plasma gas, such non-conductive material includes, but is not limited to glass, porcelain, etc. It is contemplated that one master letter can be formed on the glass with 8 blocking devices to form all letters by blocking out unwanted areas to form the different letters.

Electrodes are sealed in the channel to send an electrical charge through the channel to cause the gas to glow. The electrodes are electrically connected to electrical receptacles for plugging into an electrical source. There are male plugs and receptacles on each individual display for electrically connecting the displays together.

In order to change display or create different displays the displays can be unplugged and reconnected in other arrangements.

DESCRIPTION OF THE INVENTION

The present invention relates to a lighted display sign which is constructed of a plurality of individual plug-in signs for forming a completed message.

Figure 1:
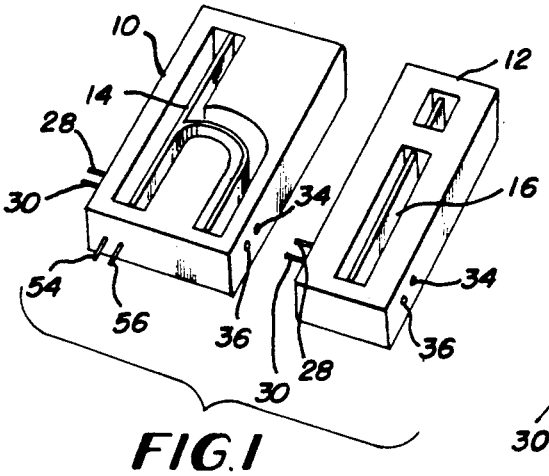
FIG. 1 is a perspective of a lighted display of the invention.

Referring to the figures, there is shown in FIG. 1 a perspective of two lighted display signs 10 and 12 of the invention. Each display has a character 14 and 16, respectively, which together spell "hi". The displays are similar in structure except for the character 14 or 16.

Figure 2:
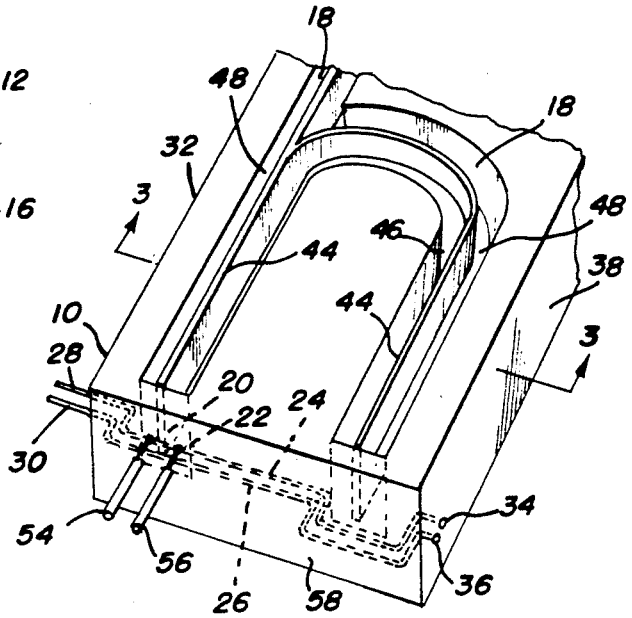
FIG. 2 is a partial perspective of a lighted display of the invention.

FIG. 2 shows display 10 moulded of a plastic resin. A channel 18 is moulded or cut in the resin in the shape of a character, in this case an "h". Electrodes 20 and 22 are bonded in the plastic resin to project into the channel 18. The other ends of electrodes 20 and 22 are connected to electric leads 24 and 26 which have male prongs 28 and 30 projecting out one side 32 of the display 10 and female receptacles 34 and 36 projecting out the other side 38. A transparent cover 40 seals the channel 18 against leaks.

Figure 4:
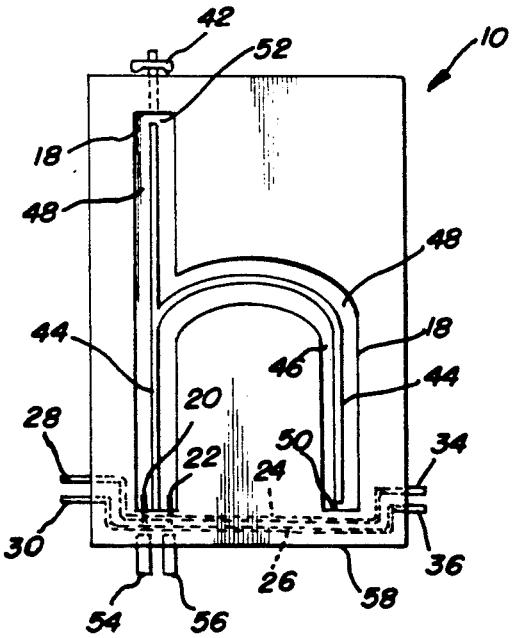
FIG. 4 is a front view of a lighted display of the invention.

A vacuum-refill valve 42 is connected to channel 18, FIG. 4, to remove air from the channel. The valve 42 is opened and connected to a vacuum pump, not shown, to draw a vacuum in channel 18. Once a vacuum is drawn in channel 18 the valve is closed to disconnect the pump and to connect a neon cylinder, not shown, to the valve. The valve 42 is again opened to pump neon into the channel 18. The valve 42 is closed and the neon cylinder removed when the channel has the required neon gas pressure.

Channel 18 is shown with a divider 44 separating the channel into two paths 46 and 48. Electrodes 20 and 22 extend into path 48 and 46, respectively. Separate paths 46 and 48 are necessary to provide a continuous path for electric current flow from electrode 20 to electrode 22. In order for the path to be continuous from one electrode to the other, divider 44 is open at 50 and 52 to connect paths 46 and 48. Paths 46 and 48 are separated by divider 44 where the electrodes 20 and 22 connect to the channel 18.

Neon gases, or some other rare gas is excited by an electrical discharge between the electrodes 20 and 22, producing a glow in the channel 18. Fluorescent dyes can be added to the neon gases to give the display different effects. In fact each display 10 and 12 can have a different color dye for effect.

Turning again to FIG. 1 display 12 plugs into display 10 where male prongs 28 and 30 are inserted in female receptacles 34 and 36. Other combinations of display characters can be plugged together to form a different message.

Alternate electric connectors 54 and 56 protrude from bottom 58 for connecting to a track type connector or to some other electrical source.

Figure 3:
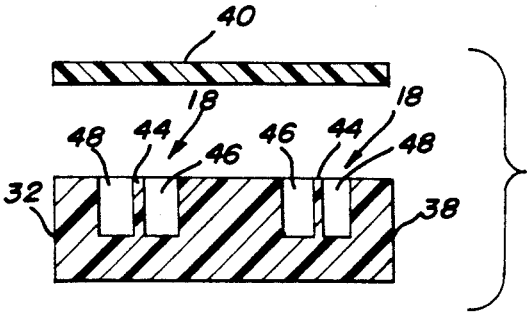
FIG. 3 is a cross section taken along the line 3—3 of FIG. 2.
Figure 5:
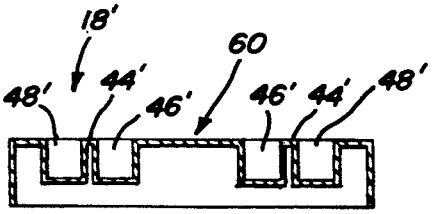
FIG. 5 is a cross section of an alternate construction of the display.

A die stamped metal sheet or glass 60 is shown in FIG. 5 forming a display. There is a channel 18' with a divider 44' and paths 46' and 48'. Metal sheet 60 is identical to the moulded display 10 of FIG. 3 except one is stamped and the other moulded. The metal sheet 60 is coated with glass, porcelain or some other non-conductive coating.

While only one embodiment of the invention has been shown, it is understood that one skilled in the art may be reading and studying the invention realize other embodiments. One should, therefore, study the drawings, description and claims for a complete understanding of the invention.

I claim:

1. A lighted display device comprising:

a base having a channel means in the shape of a character;

a divider means separating said channel means into first and second paths, said first and second paths forming a continuous path connected by openings in said divider means at extreme positions of a character to continue the path;

a first and second electrode means connected to said channel means, separated by said divider means;

said first and second electrode means being connected to electrical leads having male prongs extending through a first side wall of said base and female receptacles extending through a second side wall;

a reusable valve means repeatedly openable and closable extending through said base into said channel means for connecting said channel to sources to first evacuate the channel and then to add a neon gas to the channel for emitting light in response to an electrical discharge.

2. A lighted display device as in claim 1 wherein said base is a moulded plastic.

3. A lighted display device as in claim 1 wherein said base is a die stamped metal sheet coated with a non-conductive material.

4. A lighted display device as in claim 1 wherein said display device is electrically connected to one or more similar display devices to create a message.

5. A lighted display device as in claim 1 wherein said display device is electrically connected to one or more similar display devices to create a message.

6. A lighted display device comprising a plurality of display devices each having a pari of male prongs extending from a first side of a display device and a pair of female receptacles extending from a second side of said display device, said male prongs and said female receptacles being connected to a pair of electrodes in a character forming channel filled with a neon gas, said male prongs connect in the female receptacles of an adjoining display device, and a reusable valve means repeatedly openable and closable extending to said channel for removing air and filling the channel with neon gases.

7. A lighted display device as in claim 6 wherein said base is die stamped glass.

* * * * *